US011478906B2

(12) United States Patent
Sheehan et al.

(10) Patent No.: US 11,478,906 B2
(45) Date of Patent: Oct. 25, 2022

(54) MULTIPURPOSE HAND TOOL

(71) Applicant: Verizon Patent and Licensing Inc., Arlington, VA (US)

(72) Inventors: Erik Sheehan, Sparta, NJ (US); Marc J. Durocher, Jr., Auburn, MA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 351 days.

(21) Appl. No.: 16/844,666

(22) Filed: Apr. 9, 2020

(65) Prior Publication Data

US 2021/0316422 A1 Oct. 14, 2021

(51) Int. Cl.

| | |
|---|---|
| ***B25B 13/48*** | (2006.01) |
| ***B25B 15/00*** | (2006.01) |
| ***B25B 23/00*** | (2006.01) |

(52) U.S. Cl.

CPC ..... *B25B 13/48* (2013.01); *B25B 15/002* (2013.01); *B25B 23/0035* (2013.01)

(58) Field of Classification Search

CPC ... B25B 13/48; B25B 15/002; B25B 23/0035; B25F 1/00

See application file for complete search history.

(56) References Cited

U.S. PATENT DOCUMENTS

| | | | | | |
|---|---|---|---|---|---|
| 4,125,913 | A * | 11/1978 | Lewis | B25B 13/48 | 81/437 |
| 4,774,736 | A * | 10/1988 | Brawner | B25B 23/16 | 81/437 |
| 4,960,016 | A * | 10/1990 | Seals | B25F 1/02 | 81/177.4 |
| 5,285,543 | A * | 2/1994 | Rowe | B25B 13/06 | 81/177.4 |
| 7,127,766 | B1 * | 10/2006 | Carter | B25B 13/48 | 81/437 |
| 7,530,295 | B2 * | 5/2009 | Jones | B25F 1/00 | 81/437 |
| 7,900,304 | B2 * | 3/2011 | Bihlmaier | B27B 17/00 | 7/165 |
| 2007/0074351 | A1 * | 4/2007 | Chmelar | B25B 13/48 | 7/138 |
| 2007/0163400 | A1 * | 7/2007 | Parise | G10D 13/16 | 81/176.1 |
| 2018/0281165 | A1 * | 10/2018 | Kempiak | B25B 15/004 | |
| 2020/0246956 | A1 * | 8/2020 | Moufawad | B25B 13/56 | |

* cited by examiner

*Primary Examiner* — David B. Thomas

(57) ABSTRACT

A multipurpose hand tool may include a body portion, and a first hex socket tool integrally formed with a first side of the body portion. The multipurpose hand tool may include a second hex socket tool integrally formed with a second side of the body portion that opposes the first side of the body portion, and a screwdriver tool integrally formed with a third side of the body portion. The multipurpose hand tool may include a wrench tool integrally formed with a fourth side of the body portion that opposes the third side of the body portion.

20 Claims, 15 Drawing Sheets

600

700

700

700

700

700

700

MULTIPURPOSE HAND TOOL

BACKGROUND

Servicing network equipment (e.g., televisions, set-top boxes, optical network terminals, and/or the like) at customer premises require technicians to visit the customer premises, access the network equipment, service the network equipment, and/or the like.

DETAILED DESCRIPTION OF PREFERRED EMBODIMENTS

Figure 1A:
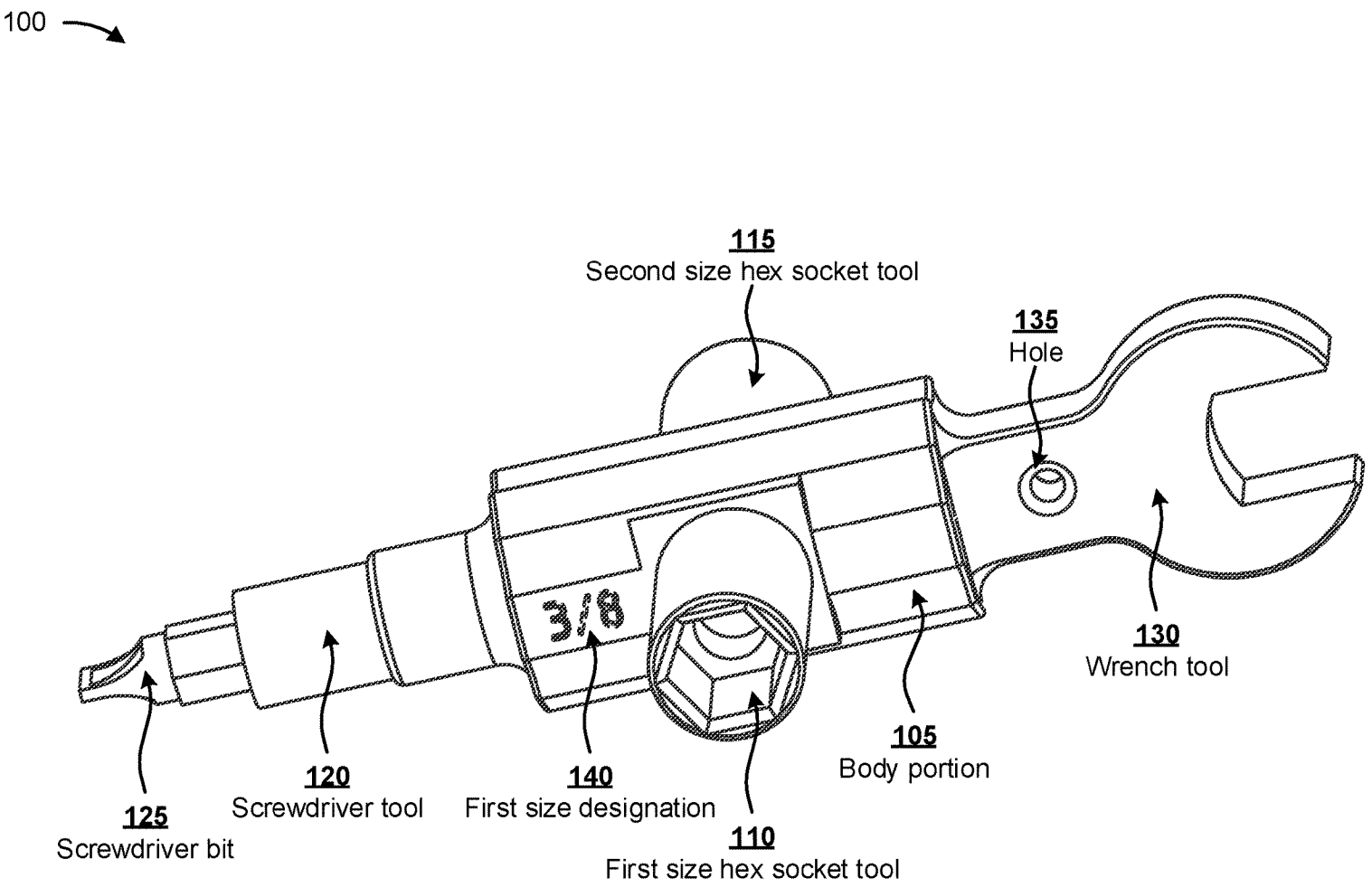
FIGS. 1A-1C are perspective diagrams of one or more example implementations of a multipurpose hand tool described herein.

The following detailed description of example implementations refers to the accompanying drawings. The same reference numbers in different drawings may identify the same or similar elements.

Sometimes technicians are unable to enter customer premises due to extraordinary events (e.g., a natural disaster, a pandemic, such as the current coronavirus pandemic, and/or the like). Other events (e.g., network power outages) may prevent technicians from traveling to customer premises in a timely manner. Such events prevent the technicians from accessing and/or servicing (e.g., troubleshooting) network equipment inside or around the customer premises, and require customers to access and/or service their network equipment themselves. However, customers may not have hand tools to access and/or service the network equipment, may have hand tools that are too small or too large to utilize with the network equipment, may have hand tools to access and/or service some network equipment but not other network equipment, and/or the like.

Some implementations described herein provide a multipurpose hand tool that enables customers to access and/or service network equipment issues themselves at customer premises. For example, the multipurpose hand tool may include a body portion, and a first hex socket tool integrally formed with a first side of the body portion. The multipurpose hand tool may include a second hex socket tool integrally formed with a second side of the body portion that opposes the first side of the body portion, and a screwdriver tool integrally formed with a third side of the body portion. The multipurpose hand tool may include a wrench tool integrally formed with a fourth side of the body portion that opposes the third side of the body portion.

In this way, the multipurpose hand tool enables customers to access and/or service network equipment issues themselves at customer premises. For example, the multipurpose hand tool may include four tools (e.g., a wrench tool, a first size hex socket tool, a second size hex socket tool, and a screwdriver tool) that enable customers and/or technicians to access and/or service network equipment. The four tools are sized and shaped to enable customers and/or technicians to access and/or service different types of network equipment and/or panels. Thus, the multipurpose hand tool conserves networking resources, human resources, and/or the like that would otherwise have been wasted utilizing malfunctioning or underperforming network equipment, unsuccessfully attempting to correct the malfunctioning or underperforming network equipment, and/or the like. Furthermore, the multipurpose hand tool allows a customer to service a product even when a technician is unavailable or cannot be permitted to enter the customer premises, saving wasted trips to customer premises by technicians, saving trips to a hardware store by the customer (e.g., especially when the hardware store is closed for weeks due to a virus and/or going to the store exposes the customer to the virus), and/or the like.

Figure 1B:
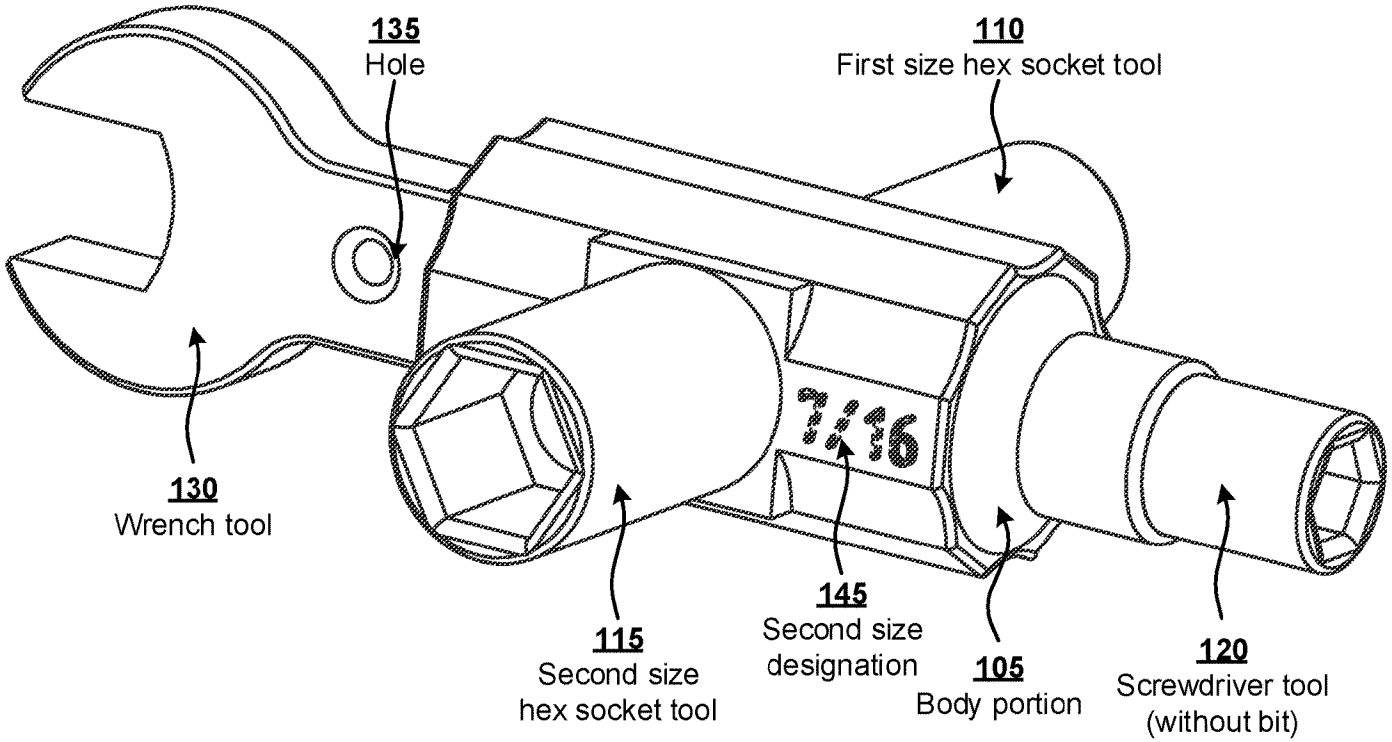
Figure 1C:
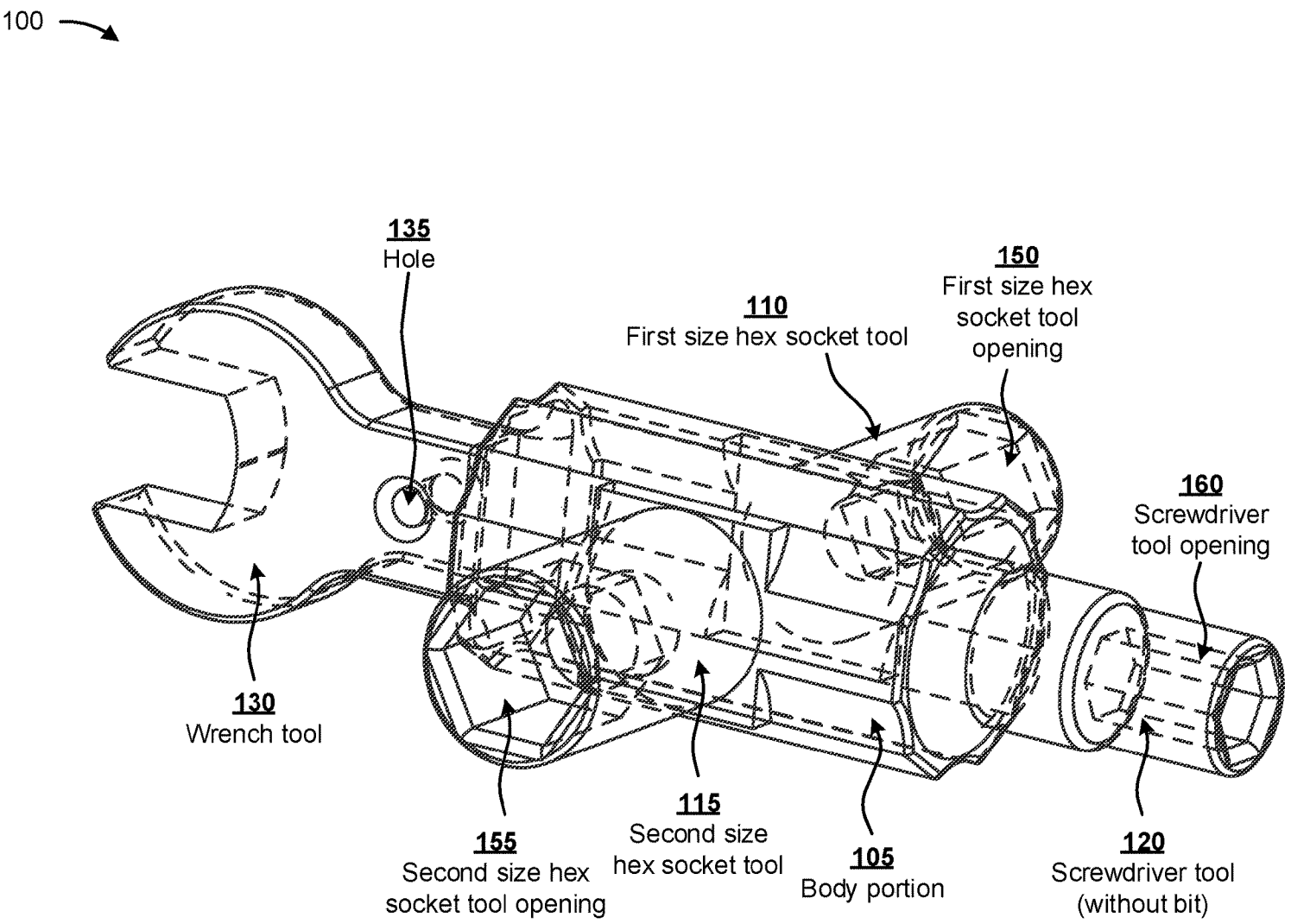

FIGS. 1A-1C are perspective diagrams of one or more example implementations 100 of a multipurpose hand tool described herein. As shown in a front perspective view of FIG. 1A, the multipurpose hand tool may include a body portion 105, a first size hex socket tool 110, a second size hex socket tool 115, a screwdriver tool 120, a screwdriver bit 125, a wrench tool 130 with a hole 135, a first size designation 140, and/or the like.

Body portion 105 may include a substantially cylindrical shape that is sized and shaped to connect with and enable manipulation of first size hex socket tool 110, second size hex socket tool 115, screwdriver tool 120, and wrench tool 130. The cylindrical shape may include a first side, a second side opposing the first side, a third side (e.g., a first end of the cylindrical shape), and a fourth side (e.g., a second end of the cylindrical shape) opposing the third side. In some implementations, the first side of body portion 105 connects to first size hex socket tool 110, and the second side of body portion 105 connects to second size hex socket tool 115. In some implementations, the third side of body portion 105 connects to screwdriver tool 120, and the fourth side of body portion 105 connects to wrench tool 130. In some implementations, body portion 105 is integrally formed with each of first size hex socket tool 110, second size hex socket tool 115, screwdriver tool 120, and wrench tool 130. For example, body portion 105, first size hex socket tool 110, second size hex socket tool 115, screwdriver tool 120, and wrench tool 130 may be molded via machine (e.g., an injection molding machine) that includes a mold sized and shaped like body portion 105, first size hex socket tool 110, second size hex socket tool 115, screwdriver tool 120, and wrench tool 130, printed using a three-dimensional printer, and/or the like.

In some implementations, body portion 105, first size hex socket tool 110, second size hex socket tool 115, screwdriver tool 120, and wrench tool 130 may be formed via multiple injection molding machines, a lathe, a three-dimensional printer, and/or the like. For example, the multipurpose hand tool may be formed from a variety of materials, such as a dielectric material (e.g., to prevent the multipurpose hand tool from shorting out network equipment contacted with the multipurpose hand tool), a plastic material, a thermoplastic material, and/or the like. In some implementations, the multipurpose hand tool may be sized and shaped so that different network equipment (e.g., coaxial cables, set-top boxes, optical network terminals, network interface devices, and/or the like) may be accessed and/or serviced with the multipurpose hand tool. Dimensions of the multipurpose hand tool are described below in connection with FIGS. 7A and 7C.

First size hex socket tool 110 may include a socket tool that is sized and shaped to engage and manipulate (e.g., rotate) a hexagonal fastener (e.g., a screw, a bolt, a nut, and/or the like of network equipment). In some implementations, first size hex socket tool 110 includes a cylindrical portion that is integrally formed with the first side of body portion 105, as described above. The cylindrical portion may include an opening provided on a side of the cylindrical portion (e.g., the side away from body portion 105). The opening may be sized and shaped to engage and manipulate (e.g., rotate) a hexagonal fastener of a first size (e.g., 0.375 inches or 9.525 millimeters, 0.4375 inches or 11.1125 millimeters, and/or the like). For example, the opening may include a depth that is sufficient enough to receive and manipulate the hexagonal fastener of the first size and hexagonal fasteners that are recessed. The opening may be sized to create a wall in the cylindrical portion with a thickness (e.g., from approximately 0.09375 inches or 2.38125 millimeters or greater) that provides sufficient strength to engage and manipulate the hexagonal fastener of the first size. As further shown in FIG. 1A, the first size may be illustrated on the first side of body portion 105 by first size designation 140 (e.g., "⅜"). First size designation 140 may be etched on, printed on, and/or the like the first side of body portion 105.

Second size hex socket tool 115 may include a socket tool that is sized and shaped to engage and manipulate (e.g., rotate) a hexagonal fastener (e.g., a screw, a bolt, a nut, and/or the like of network equipment) of a different size. In some implementations, second size hex socket tool 115 includes a cylindrical portion that is integrally formed with the second side of body portion 105, as described above. The cylindrical portion may include an opening (e.g., shown in FIG. 1B) provided on a side of the cylindrical portion (e.g., the side away from body portion 105). The opening may be sized and shaped to engage and manipulate (e.g., rotate) a hexagonal fastener of a second size (e.g., 0.375 inches or 9.525 millimeters, 0.4375 inches or 11.1125 millimeters, and/or the like). For example, the opening may include a depth that is sufficient enough to receive and manipulate the hexagonal fastener of the second size and hexagonal fasteners that are recessed. The opening may be sized to create a wall in the cylindrical portion with a thickness (e.g., from approximately 0.09375 inches or 2.38125 millimeters or greater) that provides sufficient strength to engage and manipulate the hexagonal fastener of the second size.

Screwdriver tool 120 may include a screwdriver that is sized and shaped to engage and manipulate (e.g., rotate) a fastener (e.g., a screw, a bolt, a nut, and/or the like of network equipment). In some implementations, screwdriver tool 115 includes a first cylindrical portion that is integrally formed with a second cylindrical portion. The second cylindrical portion may be integrally formed with the third side of body portion 105, as described above. The first cylindrical portion may include an opening (e.g., shown in FIG. 1C) provided on a side of the first cylindrical portion (e.g., the side away from body portion 105). The opening may be sized and shaped to receive and retain screwdriver bit 125. For example, the opening may include a depth that is sufficient enough to receive and retain removable screwdriver bit 125. In some implementations, the second cylindrical portion (or within the opening of the second cylindrical portion) may be magnetic to further retain removable screwdriver bit 125 in the opening. In some implementations, the second cylindrical portion may not include the opening and may be integrally formed with screwdriver bit 125 (e.g., screwdriver bit 125 is not removable).

Screwdriver bit 125 may removably or permanently attach to the second cylindrical portion of screwdriver tool 120 and may be sized and shaped to engage and manipulate (e.g., rotate) a fastener (e.g., a screw, a bolt, a nut, and/or the like of network equipment). In some implementations, when screwdriver bit 125 is removable, one or more different types of screwdriver bits 125 may be utilized with screwdriver tool 120, such as a flat-head screwdriver bit, a Phillips head screwdriver bit, a pozidrive screwdriver bit, a double-sided screwdriver bit, a slotted screwdriver bit, a torx screwdriver bit, an internal hex screwdriver bit, a square recess screwdriver bit, a nut setter screwdriver bit, and/or the like. Screwdriver bit 125 may be made from a dielectric material, a metal material, a plastic material, and/or the like.

Wrench tool 130 may include a wrench that is sized and shaped to engage and manipulate (e.g., rotate) a two or more sided fastener (e.g., a bolt, a nut, a coaxial cable head, and/or the like of network equipment). In some implementations, wrench tool 130 includes an arm portion that is integrally formed with the fourth side of body portion 105, as described above. The arm portion may be integrally formed with a head portion that includes an opening (e.g., or a cutout portion) to receive the two or more sided fastener. In some implementations, the opening may be sized and shaped to engage and manipulate (e.g., rotate) a fastener of a coaxial cable connected to network equipment (e.g., a television, a set-top box, and/or the like). For example, the opening may be sized and shaped to engage and manipulate (e.g., rotate) a hexagonal fastener of a particular size (e.g., 0.375 inches or 9.525 millimeters, 0.4375 inches or 11.1125 millimeters, and/or the like). In some implementations, the head portion of wrench tool 130 may include a thickness (e.g., from approximately 0.09375 inches or 2.38125 millimeters or greater) that provides sufficient strength to engage and manipulate the two or more sided fastener.

In some implementations, the head portion of wrench tool 130 may be oriented at an angle of approximately ninety degrees relative to a flat-head screwdriver tip 125 of screwdriver tool 120 in order to ensure that screwdriver tool 120 is not prevented from being manipulated due to the head portion of wrench tool 130 (e.g., striking a surface of network equipment) and to ensure that wrench tool 120 is not prevented from being manipulated due to screwdriver tool 120 (e.g., striking a surface of network equipment). In some implementations, the head portion of wrench tool 130 is oriented at an angle other than approximately ninety degrees depending on network equipment utilized with the multipurpose hand tool, a size of multipurpose hand tool, and/or the like.

As further shown in FIG. 1A, hole 135 may be formed in the arm portion of wrench tool 130. Hole 135 may be provided in the arm portion to enable a mechanism (e.g., a string, a tie wrap, a chain, and/or the like) to be provided through hole 135. The mechanism may enable the multipurpose hand tool to be connected to network equipment, a key chain, a necklace, instructions for utilizing the multipurpose hand tool, and/or the like.

FIG. 1B is a rear perspective view of the multipurpose hand tool. As shown, the multipurpose hand tool may include body portion 105, first size hex socket tool 110, second size hex socket tool 115, screwdriver tool 120, wrench tool 130 with hole 135, a second designation 145, and/or the like. Body portion 105, first size hex socket tool 110, second size hex socket tool 115, screwdriver tool 120, wrench tool 130, and hole 135 may include the features described above in connection with FIG. 1A.

Furthermore, the opening provided on the side of the cylindrical portion of second size hex socket tool 115 is visible in FIG. 1B, screwdriver tool 120 is shown without screwdriver bit 125 in FIG. 1B, and the opening provided on the side of the first cylindrical portion of screwdriver tool 120 is visible in FIG. 1B. The second size of second size hex socket tool 115 may be illustrated on the second side of body portion 105 by second size designation 145 (e.g., "7/16"). Second size designation 145 may be etched on, printed on, and/or the like the second side of body portion 105.

FIG. 1C is a rear perspective view of the multipurpose hand tool, with interior lines shown by dashed lines. As shown, the multipurpose hand tool may include body portion 105, first size hex socket tool 110, second size hex socket tool 115, screwdriver tool 120, wrench tool 130 with hole 135, a second designation 145, and/or the like. Body portion 105, first size hex socket tool 110, second size hex socket tool 115, screwdriver tool 120, wrench tool 130, and hole 135 may include the features described above in connection with FIG. 1A.

As further shown in FIG. 1C, first size hex socket tool 110 may include a first size hex socket tool opening 150, which may correspond to the opening provided on the side of the cylindrical portion of first size hex socket tool 110, as described above. Second size hex socket tool 115 may include a second size hex socket tool opening 155, which may correspond to the opening provided on the side of the cylindrical portion of second size hex socket tool 115, as described above. Screwdriver tool 120 may include a screwdriver tool opening 160, which may correspond to the opening provided on the side of the first cylindrical portion of screwdriver tool 120, as described above.

In some implementations, body portion 105, first size hex socket tool 110, second size hex socket tool 115, screwdriver tool 120, screwdriver bit 125, and wrench tool 130 of the multipurpose hand tool may sized and shaped to enable the multipurpose hand tool to be utilized by a customer for an intended installation associated with network equipment. For example, the multipurpose hand tool may be sized and shaped to enable the multipurpose hand tool to be utilized by the customer to install a set-top box, connect the set-top box to a television, install an optical network terminal, install a network interface device, connect a router, and/or the like. The multipurpose hand tool may be sized and shaped to enable the multipurpose hand tool to be utilized by the customer for intended installations with more ease relative to existing single hand tools, multitools, and/or the like.

Figure 2:
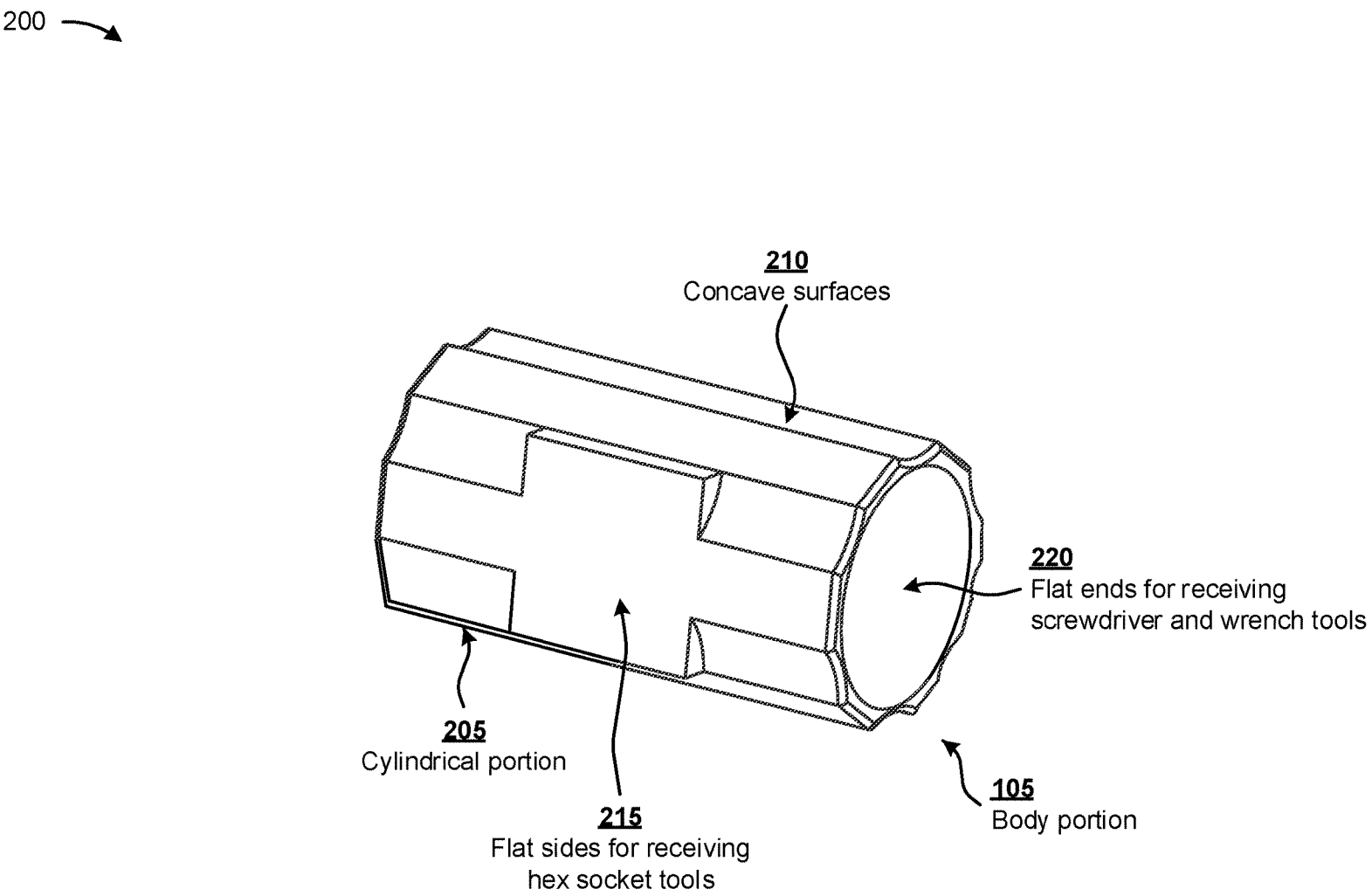
FIG. 2 is a diagram of an example body portion of the multipurpose hand tool described herein.

FIG. 2 is a diagram of an example 200 body portion 105 of the multipurpose hand tool described herein. As shown, body portion 105 may include a cylindrical portion 205 with a gripping portion (e.g., multiple concave surfaces 210) surrounding cylindrical portion 205. Cylindrical portion 205 may include a solid cylinder that is formed from a material, such as a dielectric material, a plastic material, and/or the like. Concave surfaces 210 may be molded into cylindrical portion 205 to provide a frictional grip for a user's hand when utilizing the multipurpose hand tool (e.g., to rotate screwdriver tool 120 and/or wrench tool 130).

As further shown in FIG. 2, cylindrical portion 205 may include two flat sides 215 for receiving and integrally forming with first size hex socket tool 110 and second size hex socket tool 115. For example, one of flat sides 215 may correspond to the first side of body portion 105 that is integrally formed with first size hex socket tool 110, and another one of flat sides 215 may correspond to the second side of body portion 105 that is integrally formed with second size hex socket tool 115.

As further shown in FIG. 2, cylindrical portion 205 may include two flat ends 220 for receiving and integrally forming with screwdriver tool 120 and wrench tool 130. For example, one of flat ends 220 may correspond to the third side of body portion 105 that is integrally formed with screwdriver tool 120, and another one of flat ends 220 may correspond to the fourth side of body portion 105 that is integrally formed with wrench tool 130.

Figure 3:
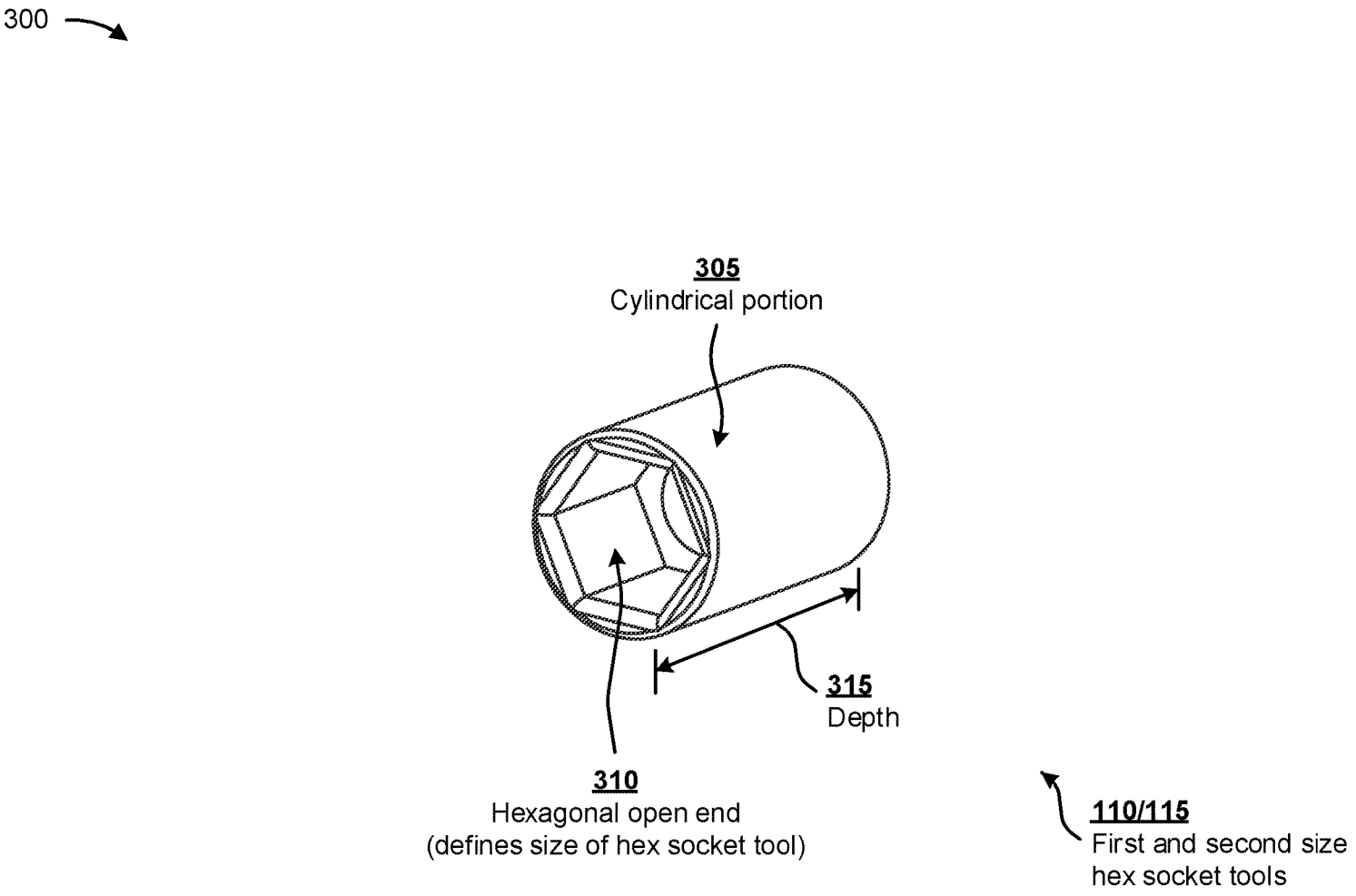
FIG. 3 is a diagram of example hex tools of the multipurpose hand tool described herein.

FIG. 3 is a diagram of example 300 hex tools (e.g., first size hex socket tool 110 and second size hex socket tool 115) of the multipurpose hand tool described herein. As shown, first size hex socket tool 110 and second size hex socket tool 115 each may include a cylindrical portion 305 with a hexagonal open end 310 and a depth 315. Cylindrical portion 305 may be formed from a material, such as a dielectric material, a plastic material, and/or the like, and may be integrally formed with a side (e.g., the first side or the second side) of body portion 105. Hexagonal open end 310 may be sized and shaped to engage and manipulate (e.g., rotate) a hexagonal fastener of a first size (e.g., 0.375 inches or 9.525 millimeters, 0.4375 inches or 11.1125 millimeters, and/or the like for first size hex socket tool 110) or a second size (e.g., 0.375 inches or 9.525 millimeters, 0.4375 inches or 11.1125 millimeters, and/or the like for second size hex socket tool 115). Depth 315 of an opening formed by hexagonal open end 310 may be sufficient enough to receive and manipulate hexagonal fasteners of the first size and the second size and hexagonal fasteners that are recessed.

Figure 4:
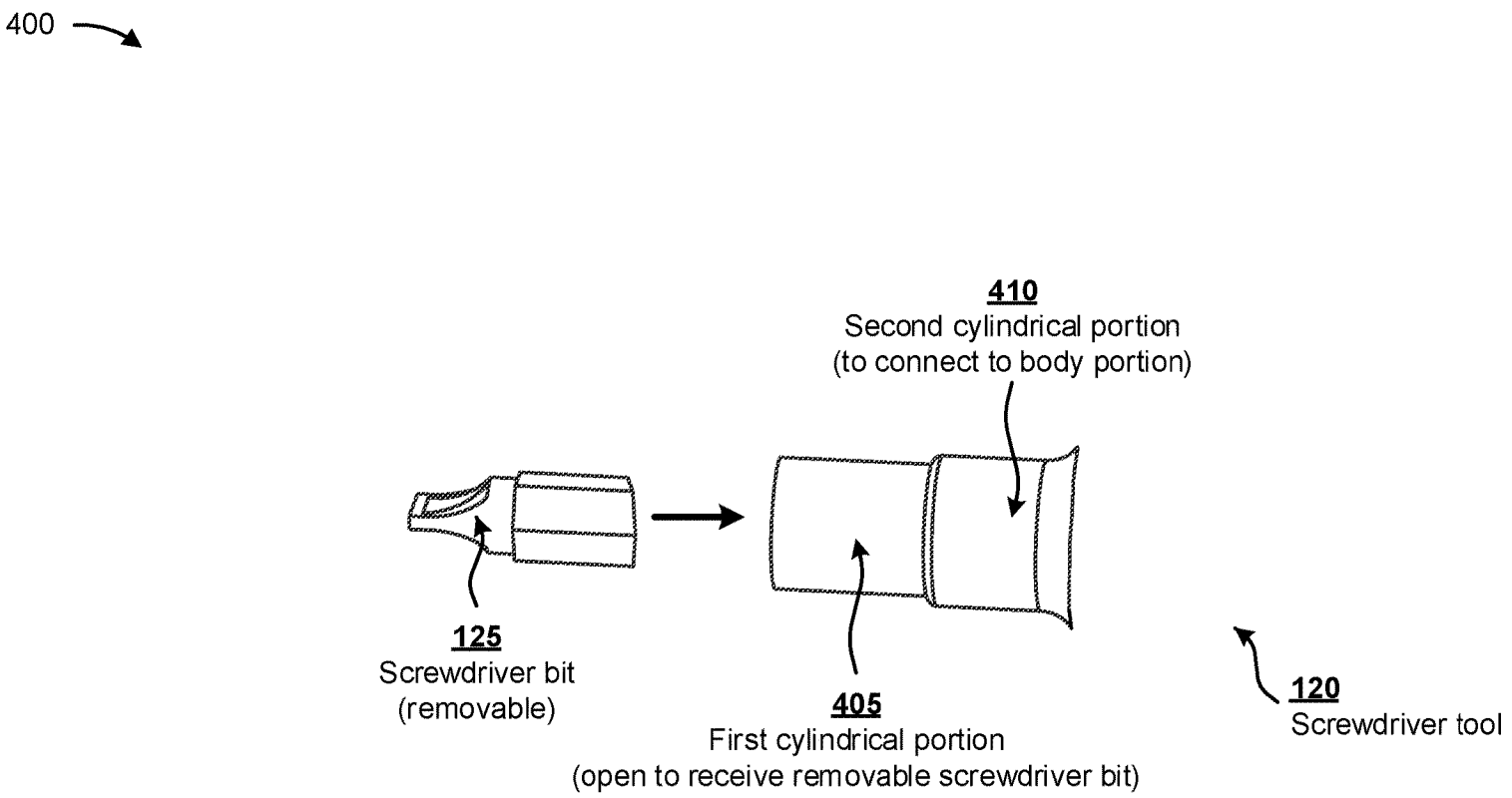
FIGS. 4 and 5 are diagrams of example implementations of a screwdriver tool provided for the multipurpose hand tool described herein.
Figure 5:
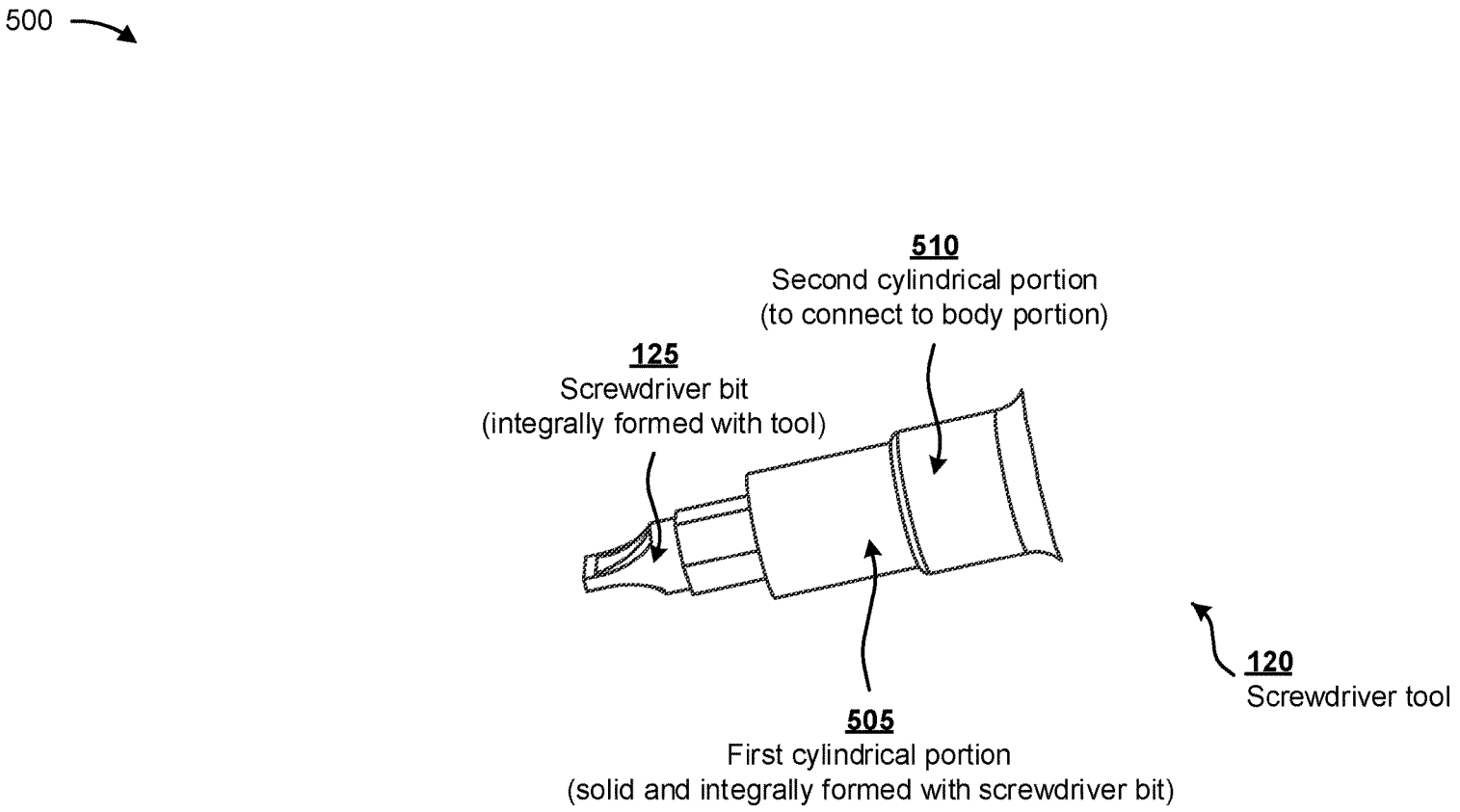

FIGS. 4 and 5 are diagrams of example implementations 400 and 500 of screwdriver tool 120 and screwdriver bit 125 provided for the multipurpose hand tool described herein. As shown in FIG. 4, screwdriver tool 120 may include a first cylindrical portion 405 that is integrally formed with a second cylindrical portion 410. First cylindrical portion 405 and second cylindrical portion 410 may be formed from a material, such as a dielectric material, a plastic material, and/or the like. In some implementations, first cylindrical portion 405 may include an opening to receive a removable screwdriver bit 125, as described above. Second cylindrical portion 410 may be integrally formed with a side (e.g., the third side) of body portion 105.

As shown in FIG. 5, screwdriver tool 120 may include a first cylindrical portion 505 that is integrally formed with a second cylindrical portion 510. First cylindrical portion 505 and second cylindrical portion 510 may be formed from a material, such as a dielectric material, a plastic material, and/or the like. In some implementations, first cylindrical portion 505 may be integrally formed with screwdriver bit 125, as described above. Second cylindrical portion 510 may be integrally formed with a side (e.g., the third side) of body portion 105.

Figure 6:
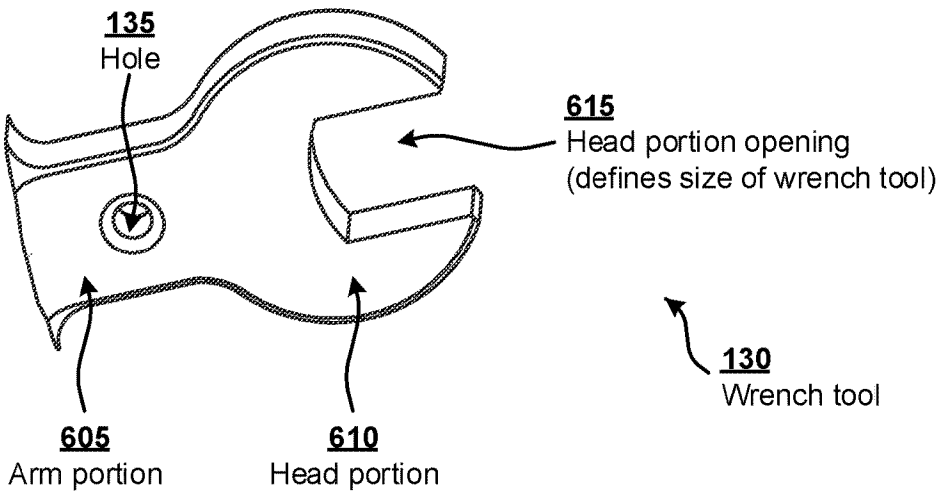
FIG. 6 is a diagram of an example wrench tool of the multipurpose hand tool described herein.

FIG. 6 is a diagram of an example 600 wrench tool 130 of the multipurpose hand tool described herein. As shown, wrench tool 130 may include an arm portion 605 that is integrally formed with a side (e.g., the fourth side) of body portion 105, as described above. Arm portion 605 may be integrally formed with a head portion 610 that includes a head portion opening 615 (e.g., or a cutout portion) to receive a two or more sided fastener. Arm portion 605 and head portion 610 may be formed from a material, such as a dielectric material, a plastic material, and/or the like. In some implementations, head portion opening 615 may be sized and shaped to engage and manipulate (e.g., rotate) a fastener of a coaxial cable connected to network equipment (e.g., a television, a set-top box, and/or the like). For example, head portion opening 615 may be sized and shaped to engage and manipulate (e.g., rotate) a hexagonal fastener of a particular size (e.g., 0.375 inches or 9.525 millimeters, 0.4375 inches or 11.1125 millimeters, and/or the like). As further shown in FIG. 6, hole 135 may be formed in arm portion 605 of wrench tool 130. In some implementations, hole 135 may be omitted from arm portion 605 of wrench tool 130.

FIGS. 7A-7F are diagrams 700 depicting front, rear, right side, left side, top, and bottom views, respectively, of the multipurpose hand tool described herein. As shown in the front view of FIG. 7A, the multipurpose hand tool may include body portion 105, first size hex socket tool 110, screwdriver tool 120 (e.g., without screwdriver bit 125), and wrench tool 130. Body portion 105, first size hex socket tool 110, screwdriver tool 120, and wrench tool 130 may include the features described above in connection with one or more of FIGS. 1A-6.

Figure 7A:
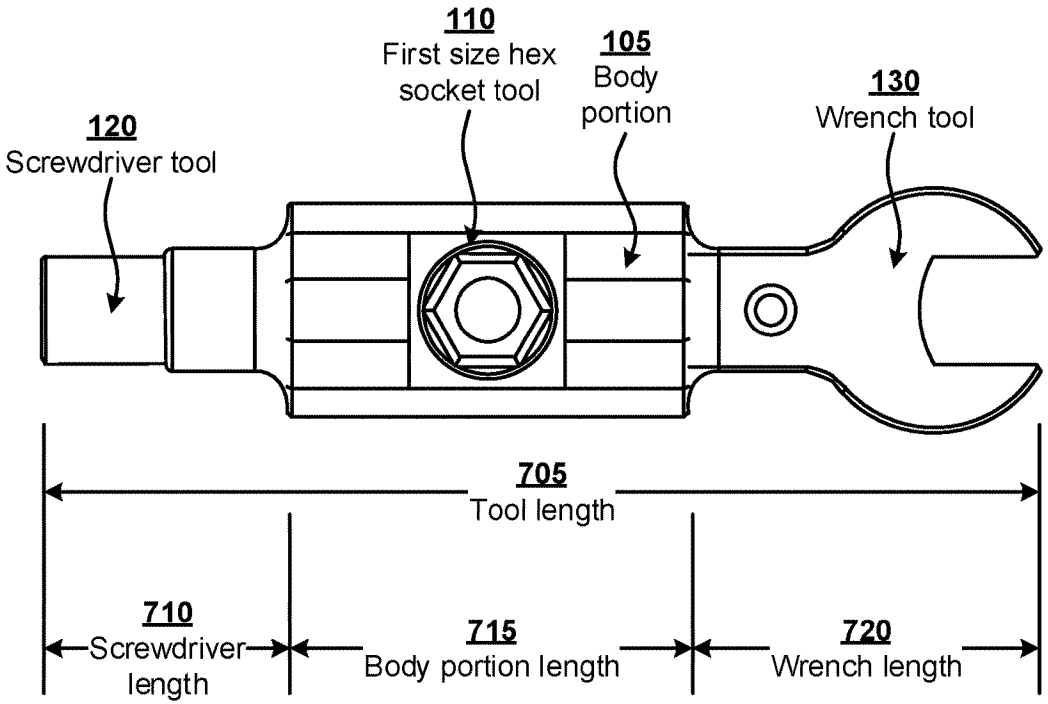
FIGS. 7A-7F are diagrams depicting front, rear, right side, left side, top, and bottom views, respectively, of the multipurpose hand tool described herein.

As further shown in FIG. 7A, the multipurpose hand tool may include a length 705, screwdriver tool 120 may include a screwdriver tool length 710, body portion 105 may include a body portion length 715, and wrench tool 130 may include a wrench tool length 720. In some implementations, length 705 includes a length in a range from approximately 3.0 inches (or 76.2 millimeters) to approximately 5.5 inches (or 139.7 millimeters), a length of approximately 5.0 inches (or 127 millimeters), and/or the like. In some implementations, screwdriver tool length 710 includes a length in a range from approximately 0.75 inches (or 19.05 millimeters) to approximately 1.25 inches (or 31.75 millimeters), a length of approximately 1.0 inch (or 25.4 millimeters), and/or the like. In some implementations, body portion length 715 includes a length in a range from approximately 1.25 inches (or 31.75 millimeters) to approximately 2.25 inches (or 57.15 millimeters), a length of approximately 1.75 inches (or 44.45 millimeters), and/or the like. In some implementations, wrench tool length 720 includes a length in a range from approximately 1.0 inch (or 25.4 millimeters) to approximately 2.0 inches (or 50.8 millimeters), a length of approximately 1.5 inches (or 38.1 millimeters), and/or the like.

Figure 7B:
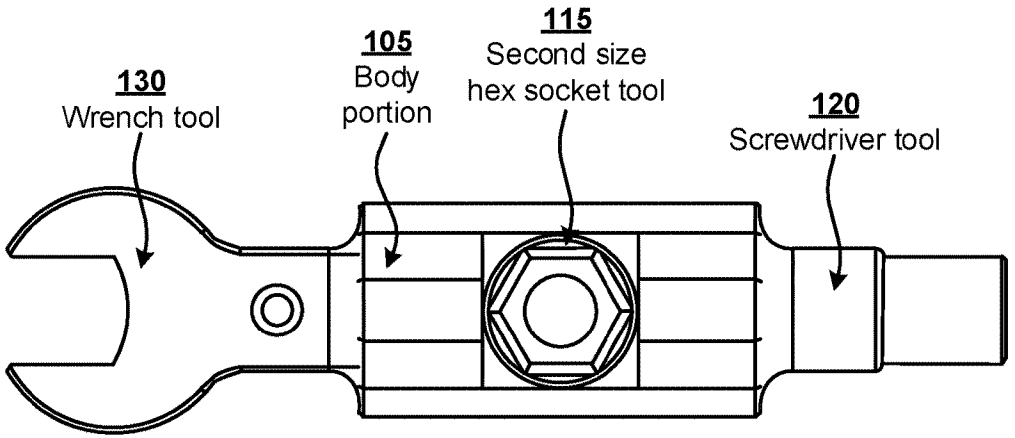

As shown in the rear view of FIG. 7B, the multipurpose hand tool may include body portion 105, second size hex socket tool 115, screwdriver tool 120 (e.g., without screwdriver bit 125), and wrench tool 130. Body portion 105, second size hex socket tool 115, screwdriver tool 120, and wrench tool 130 may include the features described above in connection with one or more of FIGS. 1A-6.

Figure 7C:
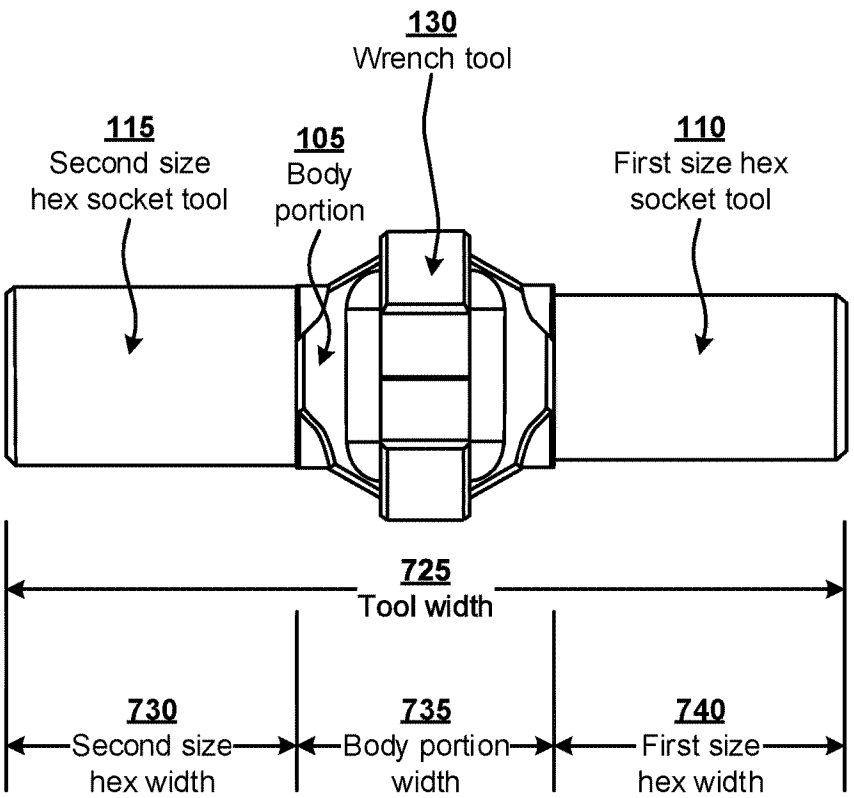

As shown in the right side view of FIG. 7C, the multipurpose hand tool may include body portion 105, first size hex socket tool 110, second size hex socket tool 115, and wrench tool 130. Body portion 105, first size hex socket tool 110, second size hex socket tool 115, and wrench tool 130 may include the features described above in connection with one or more of FIGS. 1A-6.

As further shown in FIG. 7C, the multipurpose hand tool may include a width 725, second size hex socket tool 115 may include a second size hex socket tool width 730, body portion 105 may include a body portion width 735, and first size hex socket tool 110 may include a first size hex socket tool width 740. In some implementations, tool width 725 includes a width in a range from approximately 2.25 inches (or 57.15 millimeters) to approximately 3.75 inches (or 95.25 millimeters), a width of approximately 3.0 inches (or 76.2 millimeters), and/or the like. In some implementations, second size hex socket tool width 730 includes a width in a range from approximately 0.75 inches (or 19.05 millimeters) to approximately 1.25 inches (or 31.75 millimeters), a width of approximately 1.0 inch (or 25.4 millimeters), and/or the like. In some implementations, body portion width 735 includes a width in a range from approximately 0.75 inches (or 19.05 millimeters) to approximately 1.25 inches (or 31.75 millimeters), a width of approximately 1.0 inch (or 25.4 millimeters), and/or the like. In some implementations, first size hex socket tool width 740 includes a width in a range from approximately 0.75 inches (or 19.05 millimeters) to approximately 1.25 inches (or 31.75 millimeters), a width of approximately 1.0 inch (or 25.4 millimeters), and/or the like.

Figure 7D:
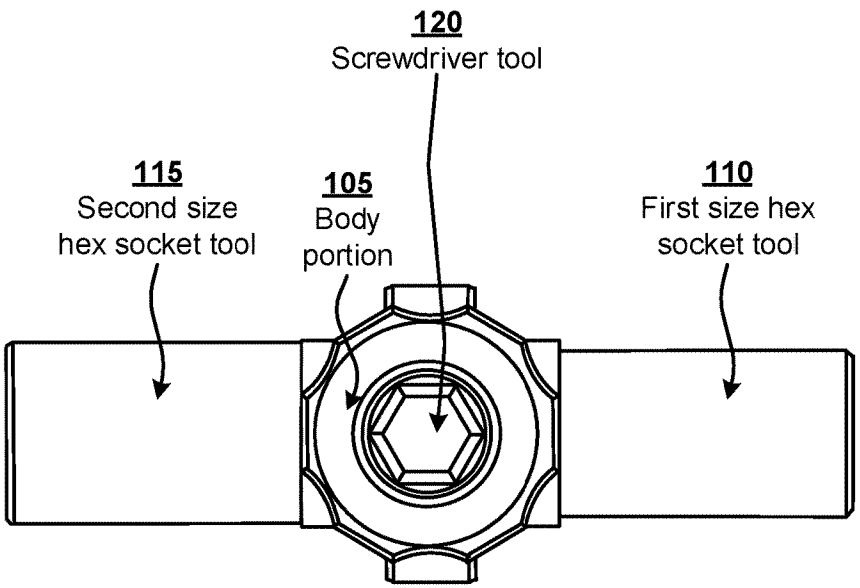

As shown in the left side view of FIG. 7D, the multipurpose hand tool may include body portion 105, first size hex socket tool 110, second size hex socket tool 115, and screwdriver tool 120. Body portion 105, first size hex socket tool 110, second size hex socket tool 115, and screwdriver tool 120 may include the features described above in connection with one or more of FIGS. 1A-6.

Figure 7E:
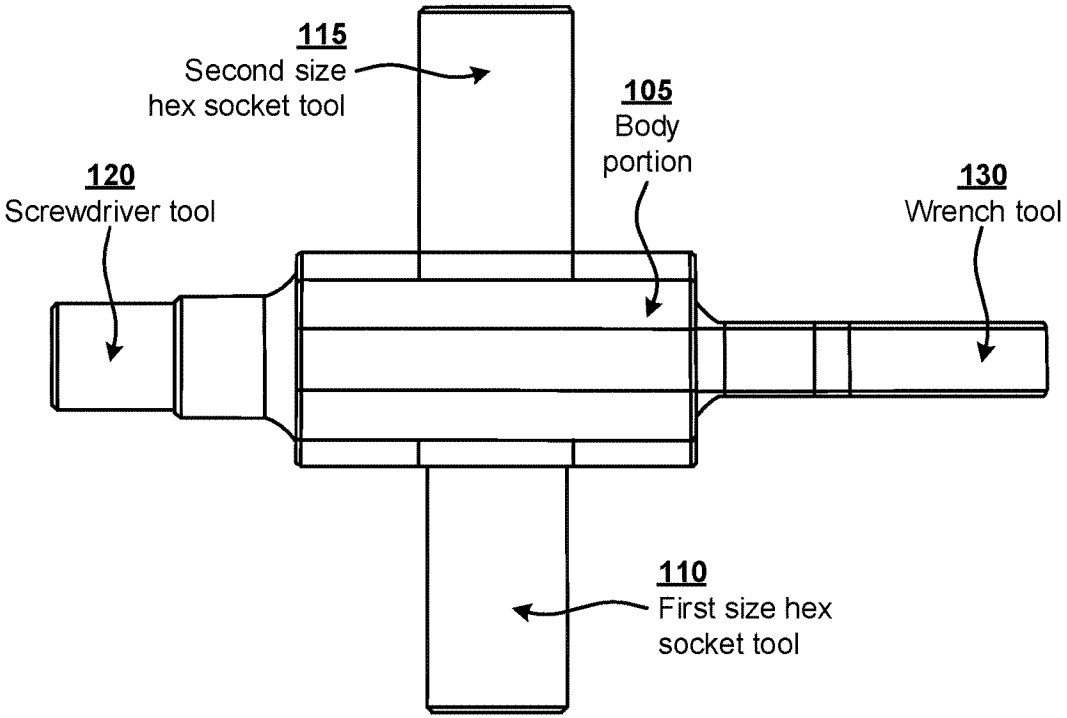

As shown in the top view of FIG. 7E, the multipurpose hand tool may include body portion 105, first size hex socket tool 110, second size hex socket tool 115, screwdriver tool 120, and wrench tool 130. Body portion 105, first size hex socket tool 110, second size hex socket tool 115, screwdriver tool 120, and wrench tool 130 may include the features described above in connection with one or more of FIGS. 1A-6.

Figure 7F:
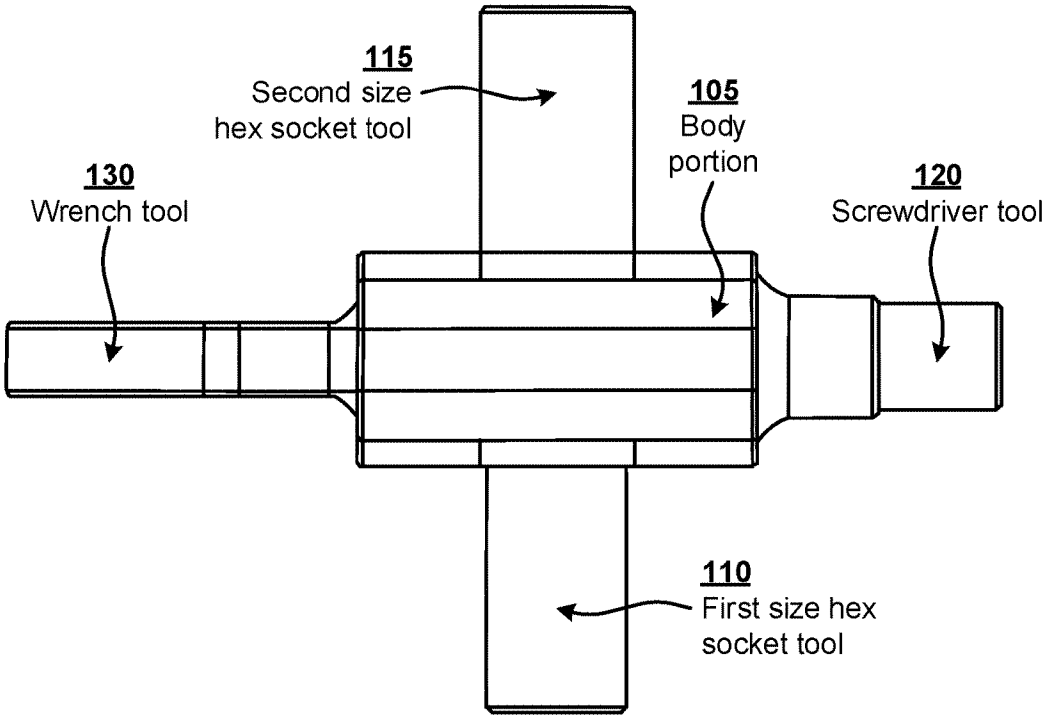

As shown in the bottom view of FIG. 7F, the multipurpose hand tool may include body portion 105, first size hex socket tool 110, second size hex socket tool 115, screwdriver tool 120, and wrench tool 130. Body portion 105, first size hex socket tool 110, second size hex socket tool 115, screwdriver tool 120, and wrench tool 130 may include the features described above in connection with one or more of FIGS. 1A-6.

In this way, the multipurpose hand tool enables customers to access and/or service network equipment issues themselves at customer premises. For example, the multipurpose hand tool may include four tools (e.g., a wrench tool, a first size inch hex socket tool, a second size hex socket tool, and a screwdriver tool) that enable customers and/or technicians to access and/or service network equipment. The four tools are sized and shape to enable customers and/or technicians to access and/or service different types of network equipment. Thus, the multipurpose hand tool conserves computing resources, networking resources, human resources, and/or the like that would otherwise have been wasted utilizing malfunctioning or underperforming network equipment, unsuccessfully attempting to correct the malfunctioning or underperforming network equipment, and/or the like.

As indicated above, FIGS. 1A-7F are provided merely as examples. Other examples may differ from what was described with regard to FIGS. 1A-7F. The number and arrangement of the tools of the multipurpose hand tool shown in FIGS. 1A-7F are provided as an example. In practice, there may be additional tools, fewer tools, different tools, or differently arranged tools than those shown in FIGS. 1A-7F. Additionally, or alternatively, one or more tools of FIGS. 1A-7F may perform one or more functions described as being performed by another one or more tools of FIGS. 1A-7F.

Figure 8:
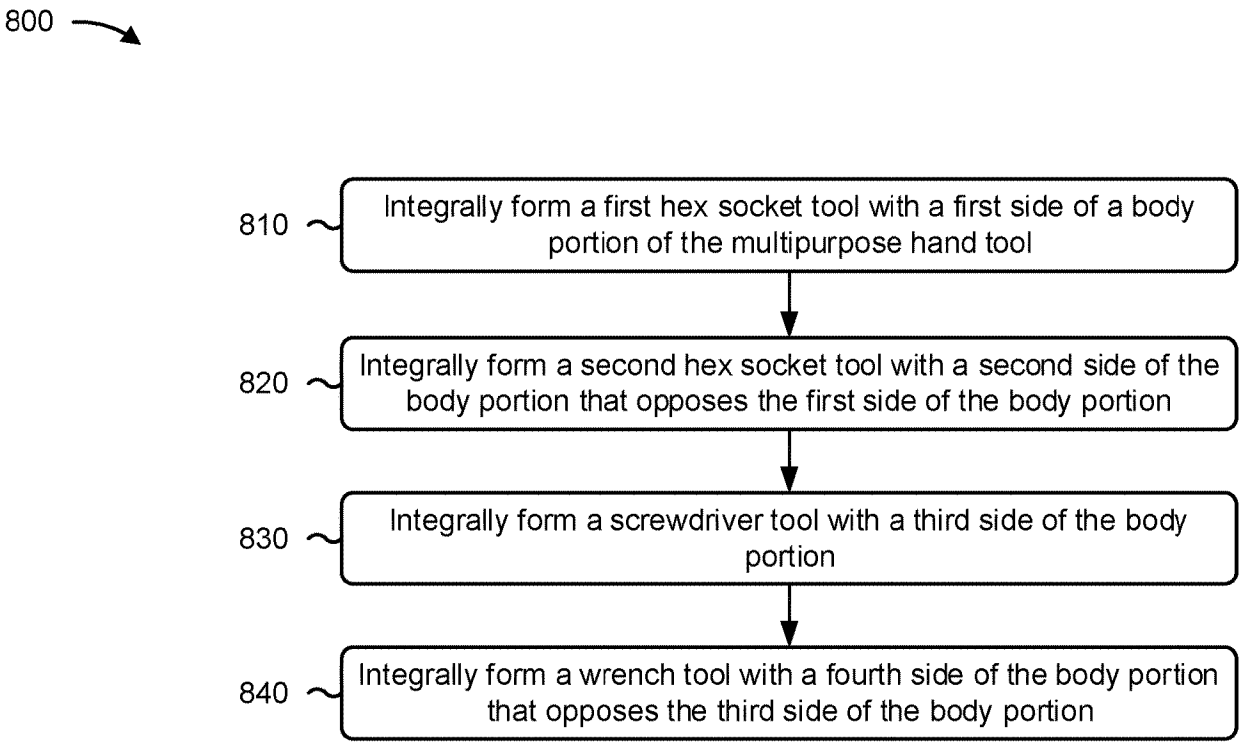
FIG. 8 is a flow chart of an example process for manufacturing the multipurpose hand tool described herein.

FIG. 8 is a flow chart of an example process 800 for manufacturing the multipurpose hand tool described herein. In some implementations, one or more process blocks of FIG. 8 may be performed by an injection molding machine. In some implementations, one or more process blocks of FIG. 8 may be performed by another device or a group of devices separate from or including the injection molding machine, such as multiple injection molding machines, a lathe, a three-dimensional printer, and/or the like.

As shown in FIG. 8, process 800 may include integrally forming a first hex socket tool with a first side of a body portion of the multipurpose hand tool (block 810). For example, the injection molding machine may integrally form a first hex socket tool with a first side of a body portion of the multipurpose hand tool, as described above. In some implementations, the body portion includes a cylindrical portion that includes a first flat side that corresponds to the first side of the body portion, a second flat side that corresponds to the second side of the body portion, a first flat end that corresponds to the third side of the body portion, a second flat end that corresponds to the fourth side of the body portion, and a gripping portion that surrounds the cylindrical portion. In some implementations, the first hex socket tool includes a cylindrical portion integrally formed with the first side of the body portion and including a hexagonal open end that defines a size of the first hex socket tool, and a particular depth to enable receipt of a fastener with a hexagonal head via the hexagonal open end.

As further shown in FIG. 8, process 800 may include integrally forming a second hex socket tool with a second side of the body portion that opposes the first side of the body portion (block 820). For example, the injection molding machine may integrally form a second hex socket tool with a second side of the body portion that opposes the first side of the body portion, as described above. In some implementations, the second hex socket tool includes a cylindrical portion integrally formed with the second side of the body portion and including a hexagonal open end that defines a size of the second hex socket tool, and a particular depth to enable receipt of a fastener with a hexagonal head via the hexagonal open end. In some implementations, the first hex socket tool is to receive a fastener with a hexagonal head of a first size and the second hex socket tool is to receive a fastener with a hexagonal head of a second size that is different than the first size. In some implementations, the first hex socket tool is to open a first type of network equipment, and the second hex socket tool is to open a second type of network equipment that is different than the first type of network equipment.

As further shown in FIG. 8, process 800 may include integrally forming a screwdriver tool with a third side of the body portion (block 830). For example, the injection molding machine may integrally form a screwdriver tool with a third side of the body portion, as described above. In some implementations, the screwdriver tool includes a first cylindrical portion with an open end to receive a removable screwdriver bit, and a second cylindrical portion integrally formed with the first cylindrical portion and the third side of the body portion. In some implementations, the removable screwdriver bit is formed from a dielectric plastic material or a dielectric metal material. In some implementations, the screwdriver tool includes a first cylindrical portion integrally formed with a screwdriver bit, and a second cylindrical portion integrally formed with the first cylindrical portion and the third side of the body portion. In some implementations, the screwdriver tool is to manipulate fasteners for a ground wire or one or more types of network equipment, and the wrench tool is to manipulate a fastener for a coaxial cable.

As further shown in FIG. 8, process 800 may include integrally forming a wrench tool with a fourth side of the body portion that opposes the third side of the body portion (block 840). For example, the injection molding machine may integrally form a wrench tool with a fourth side of the body portion that opposes the third side of the body portion, as described above. In some implementations, the wrench tool includes an arm portion integrally formed with the fourth side of the body portion, and a head portion integrally formed with the arm portion and including an opening that is sized and shaped to receive a fastener. In some implementations, the wrench tool includes a hole to receive a mechanism to attach the multipurpose hand tool to equipment. In some implementations, a head portion of the wrench tool is oriented at approximately a ninety degree angle relative to a flat-head screwdriver tip of the screwdriver tool.

Process 800 may include additional implementations, such as any single implementation or any combination of implementations described below and/or in connection with one or more other processes described elsewhere herein.

In some implementations, the multipurpose hand tool is formed from a dielectric material.

In some implementations, the multipurpose hand tool includes a first designator formed in or on the first side of the body portion and indicating a first size of a fastener with a hexagonal head to be received by the first hex socket tool, and a second designator formed in or on the second side of the body portion and indicating a second size of a fastener with a hexagonal head to be received by the second hex socket tool, wherein the first size is different than the second size.

Although FIG. 8 shows example blocks of process 800, in some implementations, process 800 may include additional blocks, fewer blocks, different blocks, or differently arranged blocks than those depicted in FIG. 8. Additionally, or alternatively, two or more of the blocks of process 800 may be performed in parallel.

The foregoing disclosure provides illustration and description, but is not intended to be exhaustive or to limit the implementations to the precise form disclosed. Modifications and variations may be made in light of the above disclosure or may be acquired from practice of the implementations.

As used herein, the term "component" is intended to be broadly construed as hardware, firmware, or a combination of hardware and software.

It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware may be designed to implement the systems and/or methods based on the description herein.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, and/or the like), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A multipurpose hand tool, comprising:
- a body portion;
- a first hex socket tool integrally formed with a first side of the body portion;
- a second hex socket tool integrally formed with a second side of the body portion that opposes the first side of the body portion;
- a screwdriver tool integrally formed with a third side of the body portion; and
- a wrench tool integrally formed with a fourth side of the body portion that opposes the third side of the body portion.

2. The multipurpose hand tool of claim 1, wherein the multipurpose hand tool is formed from a dielectric material.

3. The multipurpose hand tool of claim 1, wherein the body portion comprises:
- a cylindrical portion that includes:
  - a first flat side that corresponds to the first side of the body portion,
  - a second flat side that corresponds to the second side of the body portion,
  - a first flat end that corresponds to the third side of the body portion,
  - a second flat end that corresponds to the fourth side of the body portion, and
  - a gripping portion surrounding the cylindrical portion.

4. The multipurpose hand tool of claim 1, wherein the first hex socket tool comprises:
- a cylindrical portion integrally formed with the first side of the body portion and including:
  - a hexagonal open end that defines a size of the first hex socket tool, and
  - a particular depth to enable receipt of a fastener with a hexagonal head via the hexagonal open end.

5. The multipurpose hand tool of claim 1, wherein the second hex socket tool comprises:
- a cylindrical portion integrally formed with the second side of the body portion and including:
  - a hexagonal open end that defines a size of the second hex socket tool, and
  - a particular depth to enable receipt of a fastener with a hexagonal head via the hexagonal open end.

6. The multipurpose hand tool of claim 1, wherein the first hex socket tool is to receive a fastener with a hexagonal head of a first size and the second hex socket tool is to receive a fastener with a hexagonal head of a second size that is different than the first size.

7. The multipurpose hand tool of claim 1, wherein the screwdriver tool comprises:
- a first cylindrical portion with an open end to receive a removable screwdriver bit; and
- a second cylindrical portion integrally formed with the first cylindrical portion and the third side of the body portion.

8. The multipurpose hand tool of claim 7, wherein the removable screwdriver bit is formed from a dielectric plastic material or a dielectric metal material.

9. The multipurpose hand tool of claim 1, wherein the screwdriver tool comprises:
- a first cylindrical portion integrally formed with a screwdriver bit; and
- a second cylindrical portion integrally formed with the first cylindrical portion and the third side of the body portion.

10. The multipurpose hand tool of claim 1, wherein the wrench tool comprises:
- an arm portion integrally formed with the fourth side of the body portion; and
- a head portion integrally formed with the arm portion and including an opening that is sized and shaped to receive a fastener.

11. The multipurpose hand tool of claim 1, wherein the wrench tool includes a hole to receive a mechanism to attach the multipurpose hand tool to equipment.

12. The multipurpose hand tool of claim 1, wherein a head portion of the wrench tool is oriented at approximately a ninety degree angle relative to a flat-head screwdriver tip of the screwdriver tool.

13. The multipurpose hand tool of claim 1, wherein:
- the first hex socket tool is to open a first type of network equipment, and
- the second hex socket tool is to open a second type of network equipment that is different than the first type of network equipment.

14. The multipurpose hand tool of claim 1, wherein:
- the screwdriver tool is to manipulate fasteners for a ground wire or one or more types of network equipment, and
- the wrench tool is to manipulate a fastener for a coaxial cable.

15. The multipurpose hand tool of claim 1, further comprising:
- a first designator formed in or on the first side of the body portion and indicating a first size of a fastener with a hexagonal head to be received by the first hex socket tool; and
- a second designator formed in or on the second side of the body portion and indicating a second size of a fastener with a hexagonal head to be received by the second hex socket tool, wherein the first size is different than the second size.

16. A multipurpose hand tool, comprising:
- a body portion;
- a first hex socket tool connected to a first side of the body portion and for manipulating a first type of fastener;
- a second hex socket tool connected to a second side of the body portion and for manipulating a second type of fastener;
- a screwdriver tool connected to a third side of the body portion and for manipulating a screw;
- a wrench tool connected to a fourth side of the body portion and for manipulating a head of a coaxial cable;
- a first cylindrical portion with an open end; and
- a second cylindrical portion integrally formed with the first cylindrical portion and the third side of the body portion.

17. The multipurpose hand tool of claim 16, wherein the first hex socket tool comprises:
- a cylindrical portion integrally formed with the first side of the body portion and including:
  - a hexagonal open end that defines a size of the first hex socket tool, and
  - a particular depth to enable receipt of a fastener with a hexagonal head via the hexagonal open end.

18. The multipurpose hand tool of claim 16, wherein the second hex socket tool comprises:

a cylindrical portion integrally formed with the second side of the body portion and including:

a hexagonal open end that defines a size of the second hex socket tool, and a particular depth to enable receipt of a fastener with a hexagonal head via the hexagonal open end.

19. The multipurpose hand tool of claim 16 wherein the open end of the first cylindrical portion is sized and shaped to engage a fastener of a predetermined size.

20. A method for manufacturing a multipurpose hand tool, comprising:

integrally forming a first hex socket tool with a first side of a body portion of the multipurpose hand tool;

integrally forming a second hex socket tool with a second side of the body portion that opposes the first side of the body portion;

integrally forming a screwdriver tool with a third side of the body portion; and integrally forming a wrench tool with a fourth side of the body portion that opposes the third side of the body portion.

* * * * *